United States Patent [19]

Norman et al.

[11] 4,216,784

[45] * Aug. 12, 1980

[54] TOBACCO COMPOSITION

[75] Inventors: Vello Norman, Raleigh; Herman G. Bryant, Jr., Durham, both of N.C.

[73] Assignee: Liggett Group Inc., Durham, N.C.

[ * ] Notice: The portion of the term of this patent subsequent to Oct. 25, 1994, has been disclaimed.

[21] Appl. No.: 842,830

[22] Filed: Oct. 17, 1977

Related U.S. Application Data

[63] Continuation of Ser. No. 619,536, Oct. 3, 1977, Pat. No. 4,055,191, which is a continuation-in-part of Ser. No. 458,355, Apr. 5, 1974, abandoned.

[51] Int. Cl.[3] ..... A24B 15/28

[52] U.S. Cl. ..... 131/17 R; 131/140 B

[58] Field of Search ..... 131/2, 17, 140, 8 R, 131/15 C, 140 C

[56] References Cited

U.S. PATENT DOCUMENTS

| | | | |
|---|---|---|---|
| 3,474,792 | 10/1969 | Miller, Jr. et al. | 131/17 R |
| 3,572,348 | 3/1971 | Norman et al. | 131/17 R |
| 4,055,191 | 10/1977 | Norman et al. | 131/17 R |

FOREIGN PATENT DOCUMENTS

| | | | |
|---|---|---|---|
| 1180320 | 6/1959 | France | 131/17 R |
| 841074 | 7/1960 | United Kingdom | 131/17 R |

OTHER PUBLICATIONS

*Tobacco and Tobacco Smoke* by Wynder et al., Academic Press, 1967, New York, New York & Condon, England, p. 522.

*Primary Examiner*—Vincent Millin

*Attorney, Agent, or Firm*—J. Bowen Ross, Jr.

[57] ABSTRACT

The amount of polycyclic aromatic hydrocarbons in tobacco smoke is reduced and a substantially diminished biological activity of the tobacco smoke condensate is achieved by adding to the tobacco palladium, either in metallic or salt form, and an inorganic nitric oxide generating compound.

8 Claims, No Drawings

TOBACCO COMPOSITION

This application is a continuation of Ser. No. 619,536, filed Oct. 3, 1977, now U.S. Pat. No. 4,055,191, which in turn is continuation-in-part of U.S. Pat. application, Ser. No. 458,355, filed Apr. 5, 1974 now abandoned.

This invention relates to smoking compositions containing tobacco and having associated therewith a combination of a catalytic agent and an additive capable of releasing nitric oxide under smoking conditions. More particularly, it relates to such compositions wherein the catalytic agent is palladium, either in metallic form or as a salt, and the nitric oxide releasing additive is an inorganic nitrate salt. The tobacco smoke from the pyrolysis of the smoking compositions of the present invention exhibit a reduction in the concentration of polycyclic aromatic hydrocarbons and a substantially diminished biological activity when evaluated on experimental animals following conventional protocol.

BACKGROUND

Observations of the mechanism of combustion in tobacco compositions such as cigarettes, indicate that the smoke components responsible for biological activity of smoke are formed in the pyrolysis zone of the cigarette cone. The literature suggests that much of this biological activity, observed in connection with the testing of cigarette smoke condensate on standard experimental animals according to conventional protocol, resides in the neutral smoke fraction and more specifically within the subfraction which contains the polycyclic aromatic hydrocarbons (PCAH).

There is a body of opinion that it would be desirable to decrease the levels of PCAH compounds in cigarette smoke and this has led to a substantial amount of research aimed at reducing the proportion of such compounds in cigarette smoke.

It has been postulated that there are several pathways by which the tobacco components are converted into polycyclic aromatic hydrocarbons. One major route is the thermal degradation of various organic materials such as, e.g., cellulose into unsaturated free radical species consisting of two, four or five carbon atoms and, in case of the longer fragments, of conjugated double bonds. The free radical species subsequently participate in the pyrogenesis of aromatic ring structures, the two and four carbon fragments giving rise to unsubstituted PCAH and the five carbon branched structure giving rise to methyl substituted PCAH. Another major route is the formation of PCAH from pre-extant skeletal structures already present in tobacco such as steroids. In the latter case only minor thermally induced modifications are necessary to produce PCAH molecules. Many other routes, such as ring closures of sidechains are possible.

Since the possible pathways of PCAH formation are widely different, it is highly unlikely that any one catalytic agent or other additive would interfere with all of the different formation processes. For instance, in U.S. patent application, Ser. No. 344,589, filed Mar. 26, 1973, now abandoned, by H. G. Bryant, T. Blair Williams and V. Norman, there is disclosed a smoking composition comprising tobacco in association with finely divided metallic palladium or palladium salt. This material is disclosed to result in a tobacco composition wherein the polycyclic aromatic hydrocarbon (PCAH) content arising from the pyrolytic reactions within this composition is substantially reduced when compared to a control cigarette. It has now been found, however, that palladium catalyst alone, while apparently very efficient in eliminating the production of PCAH by some of the pyrosynthetic routes, has its limitations and does not affect all of the pathways.

The addition of nitrates and nitrites to tobacco has been previously described in various patents and publications. Thus, French Pat. No. 1,180,320 teaches the addition of unspecified amounts of nitrites to tobacco and cigarette paper to reduce the PCAH yield and U.S. Pat. No. 3,121,433 describes the addition of potassium nitrate to reconstituted tobacco sheet to improve its burning characteristics. U.S. Pat. No. 3,380,458 teaches the addition of 5.5 to 10% of potassium and sodium nitrates to tobacco ($NaNO_3$: 0.91–1.65% nitrate nitrogen, $KNO_3$: 0.76–1.39% nitrate nitrogen) and it discloses a reduction in cigarette "tar" yield which is caused by the concomitant increased burn rate of the cigarette.

Bentley and Burgan (*Analyst* 85, 727–730, 1960) describe the addition of various nitrates to tobacco in an attempt to reduce the yield of 3,4-benzopyrene. They achieved a reduction only with copper and potassium nitrates and increases with lead, silver and zinc nitrates.

Wynder and Hoffman (*Acta Pathol. Microbiol. Scand.* 52, 119–132, 1961, and *Deutch. Med. Wochenschr.* 88, 623–628, 1963) using cigarettes treated with 5% copper nitrate (0.50% nitrate nitrogen) confirmed Bentley and Burgan's finding that copper nitrate reduced the 3,4-benzopyrene yield of cigarettes. Hoffman and Wynder also demonstrated (*Cancer Res.* 27, 172–174, 1967) that the addition of 8.3% of sodium nitrate (1.37% nitrate nitrogen) resulted in a significant reduction of cigarette 3,4-benzopyrene yield as well as in a reduction of the biological activity of the smoke condensate. Pyriki et. al. (*Ber. Inst. Tabakforsch. Dresden,* 12, 37–55, 1965), on the other hand, have shown that the addition of 4% of potassium nitrate (0.55% nitrate nitrogen) increased the level of 3,4-benzopyrene in cigarette smoke by 40%.

The addition of platinum group metals to tobacco compositions to lower the concentration of benzopyrene in tobacco smoke is disclosed in British Pat. No. 841,074, issued July 13, 1960, to Johnson Matthey and Co. Ltd. The examples of the British reference show only the addition of platinum to tobacco and makes no reference to the addition of inorganic nitrate salts to the tobacco in combination with the platinum.

While most of the past investigators have expressed their research results in terms of the effect of the additive on cigarette 3,4-benzopyrene yield, it is now becoming widely recognized that this compound probably plays at most only a minor role in the biological activity of tobacco smoke condensate. It is also now recognized that the yield of 3,4-benzopyrene, which is a very minor constituent of the PCAH fraction, is not necessarily a reliable indicator of the additives' effect on the bulk of the PCAH.

It has been postulated that the effect of nitrates on the composition of cigarette smoke stems from two properties of nitrates: (a) their capacity to function as oxidants, and (b) their capacity to form the unpaired electron species, nitric oxide, in the pyrolysis zone of the cigarette that acts as a free radical scavenger. Provided a sufficiently high level is added, all nitrates tend to lower the PCAH yield of cigarettes to some degree, but depending on the particular cation, not necessarily the concentration of PCAH in the smoke condensate, as indicated in the Pyriki et. al. article discussed above.

DESCRIPTION OF THE INVENTION

It has now been found that the concentration of the PCAH fraction normally found in the smoke of a natural leaf smoking tobacco can be substantially reduced without adverse organoleptic effect on tobacco smoke by incorporating both palladium, in metallic or salt form, and an inorganic salt of nitric acid. It has been further discovered that the tobacco compositions of the present invention are unique in their ability to significantly reduce the biological activity of tobacco smoke normally produced from tobacco upon pyrolysis. The present invention involves the application of these surprising discoveries to cigarettes, cigars, pipe tobacco and other smoking tobacco compositions.

Accordingly, it is an object of this invention to provide smoking tobacco compositions which on burning substantially reduced the concentration of PCAH in the tobacco smoke.

Another object of this invention is to disclose a combination of chemical materials which when present in a smoking tobacco preparation substantially reduce the biological activity of the tobacco smoke.

Still another object of the present invention is to provide smoking tobacco compositions which substantially reduce the biological activity of the smoke and are acceptable to the smoker from a standpoint of palatability.

A further object of the present invention is to disclose a cigarette which produces less PCAH and a lowered biological activity on smoking.

These and other objects of this invention will be apparent from the accompanying disclosure and appended claims.

DETAILED DESCRIPTION OF THE INVENTION

In accordance with the present invention, the biological activity and the concentration of PCAH is substantially reduced without adverse organoleptic effect on tobacco smoke by incorporating in tobacco a catalytic mixture of palladium, in metallic or salt form, and a nitrate or nitrite salt of a metal selected from Groups Ia, Ib, IIa, IIb, IIIa, IIIb, IVa, IVb, Va, Vb, and the transition metals of the Periodic Table of Elements.

Palladium may be incorporated into the tobacco composition in finely divided metallic form, for example palladium black, and/or in the form of a salt which is decomposable in situ, preferably by heat, into metallic palladium. Water-soluble palladium salts are preferred because they are readily incorporated into and distributed throughout the tobacco composition. Illustrative examples of suitable palladium salts include simple salts such as palladium nitrate, palladium halides such as palladium chloride, diammine complexes such as palladous dichlorodiammine ($Pd(NH_3)_2Cl_2$), and palladate salts, especially ammonium salts such as ammonium tetrachloropalladate and ammonium hexachloropalladate. One form of palladium which has been found to be particularly effective in combination with tobacco to provide the smoking composition of this invention is ammonium hexachloropalladate, $(NH_4)_2PdCl_6$, (Research Organic-Inorganic Chemicals Corp.), 99.5% pure.

The catalytic amount of palladium associated with the tobacco in the smoking composition is in the range of between about 0.001% to about 1% by weight of the tobacco used to prepare the smoking composition. Although the reduced yield of polycyclic compounds arising from pyrolytic reactions of the composition have been achieved at these levels, it has been found that the best results are obtained when the palladium is in the preferred range of from about 0.01% to about 0.1% based upon the weight of the tobacco.

The nitrates which are employed in accordance with the present invention are the nitrate salts of metals of Groups Ia, Ib, IIa, IIb, IIIa, IIIb, IVa, IVb, Va, Vb, and the transition metals of the Periodic Table. The particular nitrate salt chosen for use in the practice of the present invention is one which is deemed to be non-toxic when present in the smoking compositions of the present invention.

Illustrative of the various nitrate salts which are suitable for use, form a toxicity standpoint, in the practice of the present invention are the nitrates of lithium, sodium, potassium, rubidium, cesium, magnesium, calcium, strontium, yttrium, lanthanum, cerium, neodymium, samarium, europium, gadolinium, turbium, dysprosium, erbium, scandium, manganese, iron, rhodium, palladium, copper, zinc, aluminum, gallium, tin, bismuth, hydrates thereof and mixtures thereof. Preferably, the nitrate salt is an alkali or alkaline earth metal nitrate. More preferably, the nitrate is selected from the group of calcium, magnesium and zinc with magnesium nitrate being the most preferred salt. A magnesium nitrate which has been particularly effective in combination with palladium and tobacco to provide the smoking composition of this invention is A.C.S. grade $Mg(NO_3)_2.6H_2O$ which contains (on a weight basis) less than about 0.0005% chloride ion, 0.005% sulfate ion and 0.0004% heavy metals (calculated as lead).

In addition to the nitrate salt other metal salts capable of releasing nitric oxide are useful in the practice of the present invention. Illustrative of these are the various inorganic nitrite salts such as lithium nitrite, sodium nitrite, potassium nitrite, magnesium nitrite, calcium nitrite, hydrated salts thereof and mixtures thereof.

Using the generally accepted standard toxicological procedures described in the disclosures of *Industrial Toxicology, 3rd Edition,* Hardy, et. al., Acton Mass., Publishing Sciences Group Inc., 1974; *Merck Index, 8th Edition,* Rahway, N.J., Merck & Co., Inc., 1968; *Sax Dangerous Properties of Industrial Materials, 4th Edition,* New York, Van Nostrand Reinhold Co., 1975; and *Toxic Substances List,* 1974 *Edition,* Rockville, Md., NIOSH, 1974, as the basic for forming guidelines as to the potential toxicity of metals and their salts, the following is a list of those metals whose nitrate salts would be less suitable, from a toxicity standpoint, in the practice of the present invention: antimony, beryllium, barium, cadmium, chromium, cobalt, indium, lead, mercury, nickel, osmium, polonium, ruthenium, selenium, silver, thalium, vanadium and zirconium. If any of the nitrate salts of these metals are used in the practice of the present invention, means must be provided to remove the metals from or to lower the concentration of the metal to a non-toxic level in the smoke stream.

Inasmuch as the role of the nitrate salt in the present invention is believed to be due to the ability of the salt to form nitric oxide in the appropriate temperature region of the combustion zone the choice and concentration of the nitrate may vary accordingly. Prior to the present invention, many of the nitrates and, in particular, nitrates of Group Ia metals were known to be good combustion promoters. When they are added to tobacco, the burn rate of the cigarettes is accelerated and the total smoke yield is decreased. The concentration of PCAH within the smoke condensate is, however, not necessarily decreased and is at times increased (Pyriki et. al., above). The nitric oxide yield of such nitrates is relatively low. Hence, nitrates of Group Ia metals have to be added at relatively higher levels to achieve an equivalent reduction in the concentration of the PCAH in tobacco smoke.

In addition, the added nitrates, and in particular those that accelerate burn rate when used in amounts taught by the prior art (5–10%), impart a disagreeable taste to the main stream of smoke and an obnoxious odor to the side stream aroma, thereby making the cigarette unacceptable from the point of view of a palatable cigarette. Thus, nitrate salts, when used alone in tobacco, have not proven to be universal eliminators of PCAH, particularly at levels compatible with acceptable taste and smell of cigarette smoke. Thus, when these nitrate salts are used in accordance with the practice of the present invention, i.e., in the presence of palladium, the amount of nitrate required to decrease the PCAH of the tobacco smoke is lowered significantly thereby allowing for the production of cigarettes that are more desirable from a taste and smell standpoint, yet have a significant reduction in the PCAH content of their tobacco smoke.

In the practice of the present invention, the proportion of nitrate associated with palladium and tobacco in the smoking composition is below 0.8%, and preferably is in the range of from about 0.25% to about 0.75%, calculated as added nitrate nitrogen. Although the amount of reduction of PCAH yield that is due to the nitrate can be increased as the level of nitrate is increased, the taste and aroma of smoke becomes progressively more obnoxious as the nitrate level is increased. Hence, in combination with palladium, we prefer to operate in the 0.25 to 0.60% added nitrate nitrogen range.

The incorporation of the additives of the present invention may take place at any time prior to the final packaging of the tobacco product. In the case of cigarette tobacco they may be incorporated before or after blending of the various tobaccos if, in fact, blended tobacco is employed, and the additives may be applied to one or all of the blend constituents.

The additives should be well dispersed throughout the tobacco so that they will be uniformly effective during the entire period during which the composition is smoked. Furthermore, it is important to ensure that the dispersion effectively contacts a maximum volume of smoke which is drawn in by the user. Since the catalytic activity of the palladium is most likely a surface phenomenon, the greatest likelihood of maximum contact between the smoke being drawn in by the user and the palladium is obtained when the area/volume ratio of the palladium particles is maximized for a given weight of palladium. For this reason, if the palladium is applied as metallic palladium black its particle size should preferably be smaller than about 100 U.S. mesh. Water-soluble palladium salts such as hexachloropalladates, tetrachloropalladates, nitrates, chlorides or diamine complexes have the advantage that they can be applied as a dilute solution which facilitates the achievement of good dispersion throughout the tobacco matrix.

The calcium, magnesium and zinc nitrates are very soluble in water and can be applied as a relatively concentrated solution which avoids the excessive wetting of tobacco and yet assures good distribution throughout the tobacco mass.

We have found that the combination of palladium and a nitrate compound is most efficiently applied in a conventional casing solution such as one comprising glycerin, propylene glycol and sugars to which a solution of ammonium hexachloropalladate and a sufficient amount of water to solubilize the requisite amount of nitrate compound have been added. Such a solution can be conveniently atomized on uncut tobacco strip, or by conventional casing apparatus.

Palladium black can be applied on tobacco in the form of a suspension in casing or water or in dry powder from containing the requisite amount of palladium by any convenient means such as atomization or dusting.

When palladium black is used, a convenient method of application of the additive to the tobacco is to dry blend the palladium, ground tobacco, a fibrous material and a binder. Dry blending, as in a conventional double cone blender effectively distributes the palladium over the surface of the tobacco including the pores within the tobacco surface which are large enough to accept the palladium particles.

When required, dry blending is followed by wet mixing with water and casing materials in proportions sufficient to provide the resulting mixture with the appropriate consistency for conventional reconstituted tobacco sheet manufacturing operations. The sheet is then cut into strips and a solution of nitrate compound in water is applied to the strips. This is followed by a drying step if the tobacco moisture level needs to be adjusted. This material can be used in cigarette manufacture as such or it can be blended in any desired proportion with regular tobacco.

The fibrous material which is a constituent of the dry blend can be, for example, α-cellulose or fibrous tobacco stem material. The binder portion of the dry blend may be sodium carboxymethyl cellulose, or a natural gum such as guar gum. The casing materials used in the wet mixing step are usually glycerin and propylene glycol. Of course, any other known fibrous material, binder or casing materials known to be useful in combination with tobacco products can be used in combination with or in place of those herein set forth.

The weight proportions of the additives described above for use in reconstituted tobacco sheets are within the following approximate weight ranges. The proportions shown are within the usual range required to provide useful tobacco products.

| MATERIAL | WEIGHT % |
|---|---|
| Fibrous | 4–8 |
| Binder | 1–20 |
| Casing | about 3–9 |
| Comprising: | |
| (a) glycerin | 4–6 |
| (b) propylene glycol | 0.5–2 |
| Tobacco | balance to 100% |

The smoking composition may be further processed and forming into any desired shape or use loosely e.g., cigars, cigarettes, and pipe tobacco in a manner well-known to those skilled in the tobacco art.

Alternatively, solutions of soluble palladium compounds, suspensions of palladium black in casing or water or powder mixtures can be dispersed by atomization or other convenient means on reconstituted tobaccos manufactured by methods other than the one described above or on synthetic tobacco substitute materials.

A further understanding of the invention will be had from a consideration of the following examples that amy be used in actual commercial practice and are set forth to illustrate certain preferred embodiments.

EXAMPLE I

A 0.77-pound portion of ammonium hexachloropalladate was dissolved in the minimum amount of water necessary and the solution was added to a mixture of sugar-glycerin-propylene glycol-water casing solution. A 18.94-pound portion of magnesium nitrate hexahydrate was dissolved in this mixture and sprayed in a conventional casing applicator onto 222 pounds of uncut strip tobacco blend. The treated tobacco was blended with 63.0 pounds of reconstituted tobacco sheet and 15.0 pounds of stems. The resulting blend was cut at 32 cut per inch (Sample 1). Blends containing only the palladium (Sample 2) and only the magnesium nitrate (Sample 3) as well as a control blend containing neither additive were prepared in a similar manner.

Each of the three samples and the control blend were pyrolyzed in a special pyrolysis reactor consisting of a steel cylinder about 4 inches in diameter and 5 inches along with an annular space at the central perimeter covered with a stainless steel screen. Cut tobacco was packed into this reactor at densities similar to cigarette densities and the tobacco was lit at the exposed perimeter. The burning tobacco itself thus produced the necessary heat for pyrolysis and the reactor closely approximated on a large scale the conditions extant in a burning cigarette cone. The combustion and pyrolysis products were pumped out through a small tube positioned concentrically with the cylinder and the dry solids in the smoke were analyzed for PCAH content. The concentrations of PCAH from the test tobaccos, as a percent of the concentration of PCAH from the control tobacco are tabulated as follows for a typical run:

| Sample | Additive $(NH_4)_2PdCl_6$* | Weight % Mg $(NO_3)_2$** | Concentration of PCAH Relative to Control: Weight Basis | IR Analysis*** |
|---|---|---|---|---|
| Control | — | — | 100 | 100 |
| 1 | 0.06 | 0.55 | 50 | 50 |
| 2 | 0.06 | — | 60 | 59 |
| 3 | — | 0.55 | 78 | 78 |

*As palladium
**As nitrate nitrogen
***From infrared spectral absorption in the region of aromatic C—H bonding vibrations. (11.9–14.0μ)

EXAMPLE II

A 0.64-gram portion of ammonium tetrachloropalladate was dissolved in 100 cc of water and added to 56.6 g of glycerine-sugar-propylene glycol casing solution. A 27.5-gram portion of magnesium nitrate hexahydrate was dissolved in the casing solution and the mixture was sprayed onto 400 g of cut strip blend (32 cuts per inch) (Sample 4). A blend containing only the $(NH_4)_2PdCl_4$ was prepared in a similar manner (Sample 5).

These samples were tested as described in Example I, and the data obtained are tabulated for a typical run. Data for Sample 3 and the Control of Example I are included for purposes of comparison.

| Sample | Additive, Weight % $(NH_4)$ $PdCl_4$* | $Mg(NO_3)_2$** | Concentration of PCAH Relative to Control: Weight Basis | IR Analysis*** |
|---|---|---|---|---|
| Control | — | — | 100 | 100 |
| 3 | — | 0.55 | 78 | 78 |
| 4 | 0.06 | 0.55 | 57 | 59 |
| 5 | 0.06 | — | 80 | 78 |

*As palladium
**As nitrate nitr
***From infrared spectral absorption in the region of aromatic C—H bonding vibrations. (11.9–14.0μ)

Once again, the cigarette containing both palladium and magnesium nitrate afforded materially lower PCAH concentrations than those treated with either palladium or magnesium nitrate alone. By comparing the data for Samples 1 and 4, it can be seen that ammonium hexachloropalladate gave lower PCAH levels than the corresponding tetrachloropalladate.

EXAMPLE III

A 1.0-gram portion of ammonium hexachloropalladate was dissolved in 100 cc of water and added to 56.6-grams of sugar-glycerine-propylene glycol casing solution. A 27.84-gram portion of hydrated aluminum nitrate, $Al(NO_3)_3.9H_2O$, was dissolved in the casing solution and the mixture sprayed onto 400 grams of a cut tobacco strip blend (32 cuts per inch), (Sample 6). The final tobacco blend contained 0.06 percent by weight palladium and 0.65 percent by weight added nitrate nitrogen and 0.75 percent by weight total nitrate nitrogen. A blend containing only the $Al(NO_3)_3.9H_2O$ was prepared in a similar manner, (Sample 7).

These samples were tested as described in Example I, and the data obtained are tabulated with Example IV for a typical run. Data for Sample 2 and the Control of Example I are included for purposes of comparison.

EXAMPLE IV

The same equipment, procedure and materials used in Example III were used in Example IV, except a 22.56-gram portion of potassium nitrate was used in place of the $Al(NO_3)_3.9H_2O$. The final tobacco blend (Sample 8) contained 0.06 percent by weight palladium, 0.65 percent by weight added nitrate nitrogen and 0.75 percent by weight total nitrate nitrogen. A blend containing only the potassium nitrate was prepared in a similar manner, (Sample 9).

These samples were tested as described in Example I, and the data obtained are tabulated with Example III for a typical run. Data for Sample 2 and the Control of Example I are included for purposes of comparison.

| Sample | Additive Weight % of Total Blend: $KNO_3$** | $(NH_4)_2PdCl_6$* | $Al(NO_3)_3 \cdot 9H_2O$** | Concentration of PCAH Relative to Control: Weight Basis | Analysis*** |
|---|---|---|---|---|---|
| Control | — | — | — | 100 | 100 |
| 2 | — | 0.06 | — | 60 | 59 |
| 6 | — | 0.06 | 0.65 | 64 | 58 |
| 7 | — | — | 0.65 | 77 | 62 |
| 8 | 0.65 | 0.06 | — | 63 | 52 |

-continued

| Sample | Additive Weight % of Total Blend | | | Concentration of PCAH Relative to Control | |
|---|---|---|---|---|---|
| | $KNO_3$** | $(NH_4)_2PdCl_6$* | $Al(NO_3)_3 \cdot 9H_2O$** | Weight Basis | Analysis*** |
| 9 | 0.65 | — | — | 70 | 68 |

*As palladium
**As nitrate nitrogen
***From infrared spectral absorption in the region of aromatic C—H bonding vibrations. (11.9-14.0μ). The infrared analysis is believed to be the more accurate measurement of the concentration of PCAH.

EXAMPLE V

The same equipment, procedure and materials used in Example I were used except the final tobacco blend contained 0.12 percent by weight palladium (added as $(NH_4)_2PdCl_6$) and 0.75 percent by weight nitrate nitrogen (0.65 percent of which was provided by added magnesium nitrate hexahydrate). This sample, Sample 10, was tested as described in Example I and showed a relative concentration of PCAH of 42 on a weight basis and 46 based on infrared analysis, compared to a value of 100 for the control of Example I.

BIOLOGICAL TEST

Utilizing conventional cigarette manufacturing devices, approximately 60,000 unfiltered cigarettes were produced for each of the following tobacco blends, (240,000 total cigarettes), which were treated and prepared according to the techniques and materials described in Example I.

| Sample | Weight Percent Tobacco Based on Total Tobacco Weight | | | Pd, Weight %* | Weight % Added Nitrate Nitrogen** |
|---|---|---|---|---|---|
| | Uncut Strip | RTS**** | Stems | | |
| Control | 84 | 11 | 5 | — | — |
| A | 84 | 11 | 5 | 0.05 | — |
| B | 74 | 21 | 5 | 0.05 | 0.50 |

*The palladium was added to the blend in the form of $(NH_4)_2PdCl_6$.
**The final tobacco blend prior to the addition of nitrate contained 0.22 weight percent native nitrate nitrogen. The added nitrate nitrogen was provided to the blend in the form of magnesium nitrate hexahydrate.
****Reconstituted tobacco sheet The above control and Samples A–B most closely approximate the composition of the samples in Example I.

The following tabulated data, determined by conventional laboratory techniques, represents certain chemical and physical properties of sample cigarettes selected from the 240,000 cigarettes above, prepared for biological testing.

| SAMPLE | CONTROL | A | B |
|---|---|---|---|
| Cigarette weight (grams) | 1.146 | 1.111 | 1.130 |
| Length (mm) | 85 | 85 | 85 |
| Circumference (mm) | 25 | 25 | 25 |
| Pressure Drop ($cmH_2O$) | 4.5 | 4.3 | 3.7 |
| Burn Rate (mm/min) | 4.93 | 4.84 | 5.03 |
| Moisture (wt. %) | 11.2 | 11.4 | 12.0 |
| Number Puffs | 9.7 | 9.9 | 9.6 |
| SMOKE STREAM PROPERTIES | | | |
| TPM* (mg/cigarette) | 31.8 | 31.8 | 29.8 |
| $H_2O$ (mg/cigarette) | 4.1 | 4.2 | 4.1 |
| Nicotine (mg/cigarette) | 1.63 | 1.67 | 1.27 |
| NFDS** (mg/cigarette) | 26.1 | 25.9 | 24.4 |

*Total particulate matter (wet smoke) = TPM
**Nicotine free dry solids = NFDS = TPM - (Nicotine + $H_2O$)

The smoke condensates from the above-prepared cigarettes were assayed for their respective potencies in the induction of epidermal tumors in mice according to the following procedure.

The above cigarettes were stored in the laboratory, and before smoking were equilibrated in a cabinet at laboratory temperature and 58% relative humidity. They were then smoked, for the purpose of collecting condensate, on an L&M TM wheel-type smoker as described in *Tobacco Science,* Vol. IX, pp 112–115, (1965). The cigarettes were smoked utilizing techniques commonly accepted for such procedures, that is, one 35 ml. puff per minute, to a butt-length of 30 mm. Smoke condensate was collected at liquid air temperature in a two-trap train, with overall yield determined by increase in weight of the traps. The condensate was removed from the traps with acetone, and the acetone removed under reduced pressure at a temperature of 40°–50° C. The final "dry" condensate was dissolved in an equal weight of acetone to give the solution for application.

For each test group, 50 young adult Ha/ICR female albino mice, age 8–12 weeks, were housed in clear plastic cages, 7 or 8 per cage. There were three condensate-treated groups, and two controls: a vehicle control painted with acetone only and a non-test control. The animals were maintained on Wayne Lab Blox food pellets (Allrid Mills, Inc., Chicago, Ill.) and water ad lib. The laboratory was maintained at a temperature of 75° F. and a relative humidity of 50%. At the start of the experiment, the animals had an average weight of 27 grams and each animal was individually identified by cage number and toe clipping.

The condensates were applied 5 days a week for 79 weeks, with a fresh batch of smoke condensate being prepared for each day of application.

The test procedure involved the clipping of hair from the dorsal test area prior to each test painting. The non-test control animals were hair-clipped only at the time of necropsy. Individual test paintings had a target weight of 100 mg (range 90–110) of the test solution, 5 times per week, except during the first 2 weeks when the target was 80 mg.

Animal health was continuously monitored and any seriously ill animals were sacrificed whenever necessary. The weights of the animals were measured monthly throughout the experiments. During the experiment, the changes in animal body weight were not significantly different among the cigarette groups and lagged only slightly behind the controls, as expected.

Observation of tumor and outgrowth development was made each day during condensate application. Formal checking was performed monthly after the first observation of a tumor or outgrowth and as the incidence of tumor development increased the formal checking was made biweekly. Gross visual observations include diagnosis of several kinds of non-tumorous outgrowths (warts, spicules, etc.), positive papillomas, and possible or probable carcinomas. At death or sacrifice, all outgrowths were examined histopathologically to confirm or extend the visual observations.

The data in Table I summarizes the condensate yields and the mean amounts applied per animal for each of the cigarette groups. Each mouse which survived to termination received 375 applications of condensate.

TABLE I

| Smoke Condensate Yield and Application | | | | | | |
|---|---|---|---|---|---|---|
| | Smoking Data | | | | Application | |
| Sample | No. of Smokings | Total Cartons | Total Condensate | Yield (gm*) per 1000 | Average** (mg of 50%) | Cig. per Application |
| Control | 36 | 90 | 839.2 | 46.6 | 101 | 1.1 |
| A | 36 | 94.5 | 872.8 | 56.2 | 99 | 1.1 |
| B | 36 | 93 | 826.4 | 44.4 | 96 | 1.1 |
| Acetone Control | — | — | — | — | 100 | — |

*Grams of condensate yield per 1000 cigarettes.
**Mean average amount of application in milligrams of solution (50% by weight condensate in acetone).

The tumor incidence data, as observed grossly during the experiment, are presented in detail in Table II. The one papilloma grossly observed with the condensate from cigarette Group B, tobacco treated with palladium and magnesium nitrate hexahydrate, occurred very late in the experiment while the Control cigarette, untreated tobacco, produced the earliest and highest incidence of tumors.

TABLE II

| Gross Tumor Incidence During Experiment | | | | | | |
|---|---|---|---|---|---|---|
| | Control | | A | | B | |
| Weeks | A | P | A | P | A | P |
| 23 | 1 | 1 | | | | |
| 27 | 1 | 1 | | | | |
| 31 | 2 | 2 | | | | |
| 36 | 3 | 4 | 1 | 1 | | |
| 40 | 3 | 4 | 2 | 2 | | |
| 41 | 4 | 5 | 3 | 3 | | |
| 48 | 8 | 10 | 3 | 3 | | |
| 53 | 8 | 10 | 5 | 5 | | |
| 58 | 12 | 15 | 7 | 8 | | |
| 62 | 13 | 20 | 7 | 8 | 1 | 1 |
| 66 | 14 | 24 | 9 | 12 | 1 | 1* |
| 71 | 16 | 27 | 14 | 21 | 1 | 1 |
| 73 | 18 | 33 | 16 | 24 | 1 | 1 |
| 75 | 18 | 35 | 16 | 29 | 1 | 1 |
| 77 | 19 | 37 | 17 | 32 | 1 | 1 |
| 79 | 20 | 38 | 18 | 34 | 1 | 1 |

A = Number of papilloma-bearing mice.
P = Cumulative total of papillomas observed.
*At 66th week observation, the observed papilloma of the mouse in Test Group B regressed, i.e. disappeared.

The final tumor data for all the experiments is presented in Table III. The data includes the final gross observations at the end of the eighty week test period, the number of additional new tumors and tumor-bearing animals added at necropsy, tumor and tumor-bearing animal totals, the effective number of animals and the tumor incidence. The effective number of animals is the number surviving at the time of appearance of the first tumor in each group. The tumor incidence is the tumor-bearing animals as a percentage of the effective total.

The differences in the data collected during gross external observation and at final diagnosis at necropsy can be attributed to the following factors: (1) the regression of papillomas which are still counted as part of the total incidence, (2) histological confirmation of an outgrowth or papillomas as either papillomas or carcinomas, and (3) new papillomas or carcinomas which were detected only after necropsy.

The grossly observed papilloma in the condensate from the cigarettes of Sample B regressed within a 4-week period, and the newly observed papilloma, noted at necropsy, was noted as positive but at a very early development stage.

The greatly reduced activity of the cigarettes of the present invention, cigarette Sample B, is further borne out by the observations with the other cigarettes in that the rate of regression with the others was quite low (15% or less), and that a considerable number of new papillomas were found at necropsy.

No tumors were observed in either of the acetone or non-test control groups and therefore they do not appear in the Table.

TABLE III

| Papillomas and Carcinomas Observed During Experiment and at Necropsy | | | |
|---|---|---|---|
| During Experiment | Control | A | B |
| Animals with tumor | | | |
| Total | 20 | 17 | 1 |
| Regressed* | 0 | 1 | 1 |
| Tumors observed | | | |
| Total | 38 | 34 | 1 |
| Regressed | 6 | 4 | 1 |
| At Necropsy | | | |
| Animals with papilloma only | | | |
| Confirmation | 9 | 12 | 0 |
| New | 0 | 2 | 1 |
| Papillomas | | | |
| Confirmed | 18 | 25 | 0 |
| New | 10 | 9 | 1 |
| Animals with carcinoma | | | |
| Confirmed** | 10 | 5 | 0 |
| New | 1 | 0 | 0 |
| Carcinomas | | | |
| Confirmed | 18 | 5 | 0 |
| New | 4 | 0 | 0 |
| Total*** | | | |
| Tumor-positive animals | 21 | 19 | 2 |
| Tumors | 52 | 43 | 2 |
| Effective number of animals | 50 | 48 | 43 |
| % Incidence (Tumor + Eff.) | 42% | 40% | 4.7% |

*Positive papilloma which disappeared and was not found at necropsy.
**Confirmed as carcinoma, whether original visual observation had been "papilloma," "possible carcinoma," or "probable carcinoma."
***Totals include animals (or tumors) counted as regressions plus all necropsy findings.

the survival of the experimental animals, showing the respective death dates for each animal, divided into tumor-free and tumor-bearing groups, is presented in Table IV. The data confirms the conclusions of the tumor-incidence data presented in Tables II and III, that is, the experimental animals which were painted with smoke condensate from tobacco treated with both palladium and magnesium nitrate hexahydrate showed a significant reduction in biological activity.

The PCAH concentration data for the cigarettes of the 3 biological test groups is presented in Table V. The same equipment and procedure used in Example I were used to collect and measure the PCAH of the smoke condensates of the biological test groups of cigarettes.

The PCAH concentration of the smoke condensate from the cigarettes of Sample B (tobacco treated with palladium and magnesium nitrate hexahydrate) was only slightly lower than that of Sample A (tobacco treated with palladium alone); however, the biological activity of the smoke condensate of Sample B was significantly lower than that of Sample A. While the PCAH concentration of the smoke from the additive cigarettes was decreased, the observed reduction in the biological activity may have been the combined result of reduced PCAH concentration and a reduction in the concentration of other select biological active species in the cigarette smoke.

The calculations used in Table V for determining the PCAH concentration values relative to the controls were used to arrive at the relative PCAH concentrations reported throughout this specification.

Other conventional tobacco additive materials, such as flavorants and humectants, in addition to those described above may be used in the practice of the present invention without deviating from the scope thereof. However, certain experimental results have indicated that the addition of long chain fatty acids in relatively large amount (about 4% by weight) to the tobacco is not as effective in the practice of the present invention.

References herein to biological activity of tobacco smoke are based solely on the results obtained from experimental animal testing procedures following conventional protocol, such as set forth hereinabove.

While the invention has been described in detail with particular reference to preferred embodiments thereof, it will be understood that variations and modifications can be effected within the spirit and scope of the invention as described hereinabove and as defined in the appended claims.

TABLE IV

| Time of Death in Tumored and Tumor-Free Populations | | | | | |
|---|---|---|---|---|---|
| Sample | Tumor | Number | Week of Death | 80-Week Survivors | Total |
| Control | –** | 17 | 23,31,36,44,49,51,52,55,57,62,64,65,66,68,72,72,79 | 12 | 29 |
| | +*** | 9 | 48,61,72,73,78,78,78,78 | 12 | 21 |
| A | – | 11 | 8,15,46,47,51,55,56,71,75,76,78 | 20 | 31 |
| | + | 3 | 68,76,76 | 16 | 19 |
| B | – | 19 | 27,29,38,57,58,59,60,63,63,64,65,66,67,71,71,73,75,75,78 | 29 | 48 |
| | + | 0 | | 2 | 2 |
| Acetone | – | 17 | 13,39,40,48,50,57,60,60,64,65,67,70,70,70,71,75,76 | 33 | 50 |
| NTC* | – | 24 | 18,36,41,42,51,53,54,56,56,61,65,67,67,68,68,68,69,69,69,70,72,73,73,78 | 26 | 50 |

*NTC - Non-test control
**– - Tumor-free experimental animal population
***+ - Tumored experimental animal population

TABLE V

PCAH DATA FOR BIOLOGICAL CIGARETTE TEST GROUPS

| SAMPLE | TOTAL DRY SMOKE SOLIDS GRAMS/1000 CIGARETTES | PCAH, MILLIGRAMS/M** CIGARETTES | PCAH/TOTAL DRY SOLIDS | RELATIVE CONCENTRATION OF PCAH TO CONTROL WEIGHT BASIS | IR RATIO* $3050cm^{-1}$ / $2960 cm^{-1}$ | RELATIVE CONCENTRATION OF PCAH TO CONTROL, IR BASIS |
|---|---|---|---|---|---|---|
| Control | 30.5 | 53.2 | 1.74 | 100 | 0.258 | 100 |
| A | 28.1 | 44.3 | 1.58 | 91 | 0.206 | 75 |
| B | 20.7 | 32.1 | 1.55 | 89 | 0.187 | 72 |

*Ratio of absorbance peaks appearing at wavelengths of $3050cm^{-1}$ and $2960cm^{-1}$.
**M = 1000.

What is claimed is:

1. A smoking composition comprising:
(a) tobacco,
(b) palladium in an amount of from about 0.001 to about 1 weight percent based on the weight of the tobacco, and
(c) an inorganic nitrite salt in an amount of from about 0.25 to about 0.75 weight percent calculated as added nitrite nitrogen.

2. The smoking composition of claim 1 wherein the concentration of palladium is from about 0.01 to about 0.10 weight percent.

3. The smoking composition of claim 2 wherein the palladium is in the form of a palladium salt thermally decomposable to metallic palladium.

4. The smoking composition of claim 3 wherein the palladium salt is a water soluble salt.

5. The smoking composition of claim 4 wherein palladium salt is selected from the groups of nitrate, a halide salt, a diamine complex of palladium and a palladate salt.

6. The smoking composition of claim 5 wherein the palladium salt is ammonium tetrachloropalladate.

7. The smoking composition of claim 5 wherein the palladium salt is ammonium hexachloropalladate.

8. The smoking composition of claim 1 wherein the inorganic nitrate salt is selected from the group consisting of lithium nitrite, sodium nitrite, potassium nitrite, magnesium nitrite, calcium nitrite, hydrated salts thereof and mixtures thereof.

* * * * *